United States Patent [19]

London et al.

[11] Patent Number: 4,640,162

[45] Date of Patent: Feb. 3, 1987

[54] APPARATUS FOR FORMING AND PRESENTING BIAS CUT GUSSETS IN THE FORMATION OF PANTY HOSE GARMENTS

[75] Inventors: J. Reid London, Winston-Salem; Cecil R. Bell, Jr., Pinnacle; A. Russell Edwards, Winston-Salem; Willie M. Lathery, Germanton; Lee A. Efird, Kernersville, all of N.C.; Richard M. Porter, Hartsville, S.C.; Stephen K. Shaw, Winston-Salem, N.C.; Thomas J. Costello, Kernersville, N.C.; August A. Pike, Winston-Salem, N.C.; Donald G. Bell, Mocksville, N.C.; Harold Setliff, High Point, N.C.

[73] Assignee: Sara Lee Corporation, Winston-Salem, N.C.

[21] Appl. No.: 838,314

[22] Filed: Mar. 10, 1986

[51] Int. Cl.[4] ..... B26D 7/06; B21D 43/00

[52] U.S. Cl. ..... 83/152; 83/154; 29/2.25; 112/21.15; 112/262.3

[58] Field of Search ..... 83/152, 154, 151, 153; 29/2.25; 271/107; 112/121.15, 262.3

[56] References Cited

U.S. PATENT DOCUMENTS

| | | | |
|---|---|---|---|
| 893,300 | 7/1908 | Bewsie | 29/2.25 |
| 2,520,628 | 8/1950 | Elsner | 271/107 X |
| 3,145,603 | 8/1964 | Biben | 83/154 |
| 3,350,744 | 11/1967 | Sederlund et al. | 83/152 X |
| 3,456,816 | 7/1969 | Galloway | 271/107 X |
| 4,047,272 | 9/1977 | King et al. | 29/2.19 |
| 4,122,555 | 10/1978 | Safrit et al. | 2/401 |
| 4,188,898 | 2/1980 | Bell, Jr. et al. | 112/262.1 |
| 4,267,785 | 5/1981 | Osho | 112/121.12 |
| 4,433,774 | 2/1984 | Lopes | 83/152 X |
| 4,461,197 | 7/1984 | Seaman | 83/152 |
| 4,539,924 | 9/1985 | Bell, Jr. et al. | 112/121.15 X |

*Primary Examiner*—H. Hampton Hunter

*Attorney, Agent, or Firm*—Charles Y. Lackey; William S. Burden

[57] ABSTRACT

A system for forming substantially diamond-shaped gussets to be used in the production of panty hose garments wherein the gussets are formed by severing a circular knit tube along a bias angle of approximately 30° subsequently to form strips having a width corresponding to the desired width of a gusset. The strip then is severed along a prescribed angle of approximately 30° to define a gusset wherein the fabric wales extend parallel to a line extending from one point to the diagonally opposite point of the diamond-shaped gusset. The gusset is then transferred and oriented for subsequent sewing to hosiery blanks in the forming of panty hose.

11 Claims, 11 Drawing Figures

APPARATUS FOR FORMING AND PRESENTING BIAS CUT GUSSETS IN THE FORMATION OF PANTY HOSE GARMENTS

BACKGROUND OF THE INVENTION

This invention relates to knitted garments and more particularly to the forming and handling of gussets or crotch pieces in which two knitted stocking blanks are combined with a gusset insert to provide a panty hose.

The patent to Cecil R. Bell, Jr. et al., U.S. Pat. No. 4,188,898, discloses a machine for attaching gussets to hosiery blanks wherein a cutting device severs gusset inserts from a gusset material supply and the severed inserts are placed in clamps prior to being sewn to slit hosiery blanks.

The patent to Osho Takatori, U.S. Pat. No. 4,267,785, also shows an apparatus somewhat similar to that of U.S. Pat. No. 4,188,898 but having an insert cutting and transferring device somewhat different therefrom.

U.S Pat. No. 4,122,555 discloses the formation of a crotch insert by diagonally cutting a relatively narrow strip of fabric having selvage edges to form a diamond-shaped crotch insert. The wales are parallel with the selvage edges, and the diagonal lines of cut are at an angle of approximately 50° from the selvage edges.

The present invention relates to a new and improved system for forming gussets by cutting the gusset material in a prescribed manner and for presenting gussets to clamps in which they are held as they are sewn to hosiery blanks. The invention may be employed with machines of the type disclosed in above-mentioned U.S. Pat. Nos. 4,188,989 and 4,267,785, and reference may be made to the patents, if needed, for details of the clamps, sewing devices, hosiery blanks conveying apparatus, etc.

In the past, one method of producing gusset fabric consists of knitting tubular fabric, slitting the tubular fabric to open width, rolling the width of fabric into an elongated roll, and subsequently slitting the elongated roll into a series of narrow rolls, each having a width approximating the width or length of a gusset. In an effort to eliminate waste of the fabric, particularly at the ends of the open width rolls, the tubular knit fabric was cut on a spiral. However, this resulted in the wales of the gusset fabric being at an angle when sewn into the panty hose. It is significant to maintain the wales of a gusset insert running from leg to leg when the hosiery blanks and gusset are sewn together.

With the foregoing in mind, it is an object of the present invention to form diamond-shaped gussets from tubular fabric by cutting the fabric along a preselected bias angle such that the wales in each gusset insert run from leg to leg of a panty hose garment after the garment is sewn.

Another object of the invention is the provision of a new and improved system for presenting a gusset to a pair of hosiery blanks for subsequent sewing into a panty hose garment.

Other features and advantages of the invention will be readily apparent to those skilled in the art during the course of the following description of the invention.

DETAILED DESCRIPTION OF THE INVENTION

Figure 1:
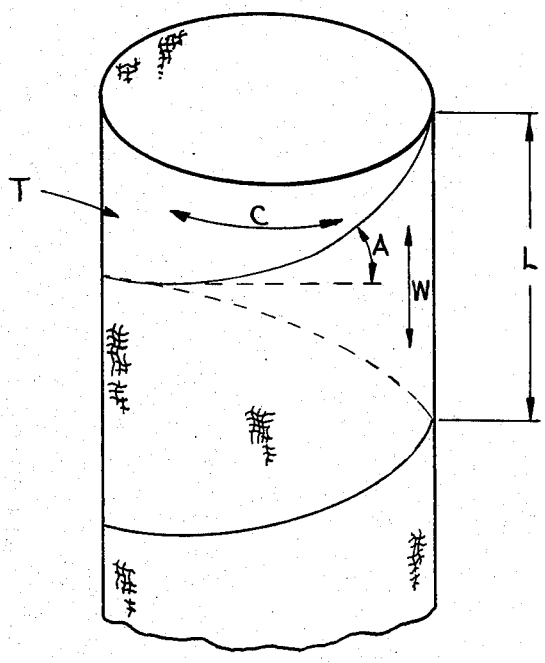
FIG. 1 is a view in perspective of a portion of knit tubular fabric illustrating the manner in which the fabric is initially bias cut into a relatively wide strip.
Figure 8:
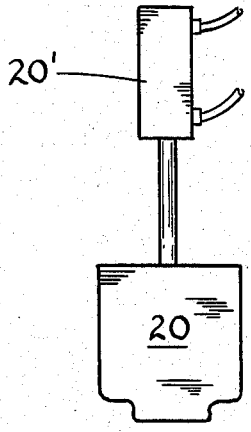
FIG. 8 is a top plan view of the gusset pusher plate and the actuator therefor.
Figure 2:
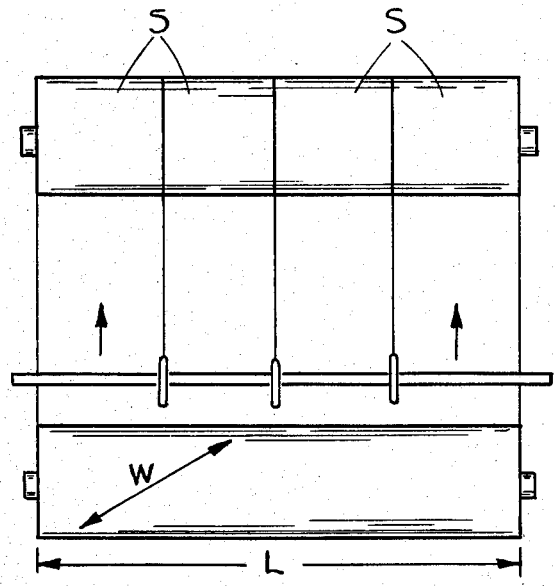
FIG. 2 is a view somewhat similar to FIG. 1 and illustrating the manner in which the relatively wide strip is severed into a plurality of narrow strips.

Referring initially to FIGS. 1 and 2, a continuous tube T of seamless knitted fabric is cut on a bias angle A and wound to produce a roll R of fabric having a preselected length L. The length L depends upon the width of the tubular fabric T. The roll is then slit and wound into a plurality of rolls S. The bias angle A mary vary somewhat; however, in the preferred embodiment the angle is 30°. Narrow strips S could be cut from the tubular fabric if so desired rather than cutting a wide strip and subsequently slitting the wide strip into narrow strips.

The width of the rolls S may vary. However, in a preferred embodiment the rolls are approximately 3¼ inches wide.

Referring to FIGS. 3A–3D, gusset material is unwound from a roll S and intermittently severed at an angle B to define individual diamond-shaped gussets G. Each severed gusset is rotated from the FIG. 3B position to the FIG. 3C position before being advanced and oriented in a selected position for combining with two hosiery blanks. It is important that the wales of the fabric forming the gusset G run leg to leg of the panty hose garment.

The apparatus for cutting and orienting the gussets is illustrated by FIGS. 4–8.

Figure 4:
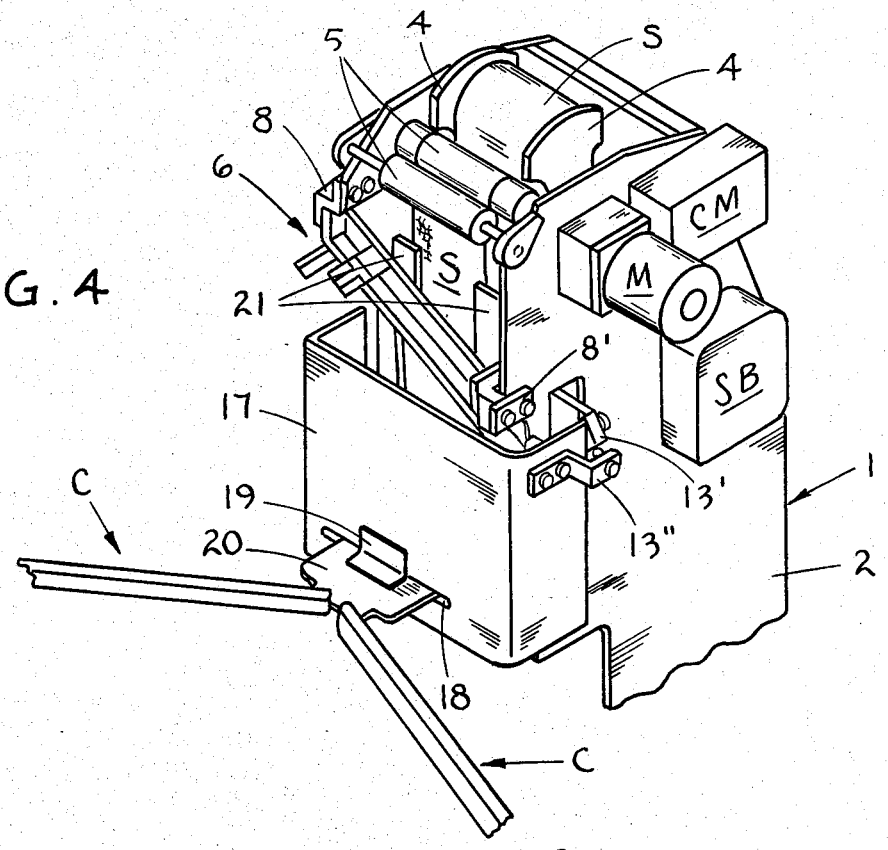
FIG. 4 is a perspective view of the mechanism for cutting and placing gussets in clamping arrangements prior to sewing to hosiery blanks.

As shown in FIG. 4, a frame generally shown at 1 is supported in a conventional manner upon a line closer machine of the type as disclosed, for example, by U.S. Pat. Nos. 4,188,898 and 4,267,785, and faces a clamping arrangement C, shown schematically, which corresponds to clamps 64 of U.S. Pat. No. 4,188,898. The frame 1 includes opposite vertically extending side members 2, 3 and a U-shaped front member 17 attached to said side members. Spaced upstanding plates 4 are attached to frame 1 by any conventional means for supporting a gusset material supply roll S. Gusset roll feed rolls 5, 5, a feed roll drive motor M, motor control means MC, a shearing assembly 6 and a gusset transferring and orienting manifold assembly are supported by members 2, 3, 17. Side plate 3, FIG. 6, also supports shear and manifold double-acting fluid cylinders 13 and 14 respectively, fluid motor controls means 15, and photocell or the like sensing means 16.

Located near the lower portion of U-shaped front member 16 is a slot 18 which is in alignment with clamps C and an L-shaped guide member 19. The L-shaped guide member 19 is attached to the member 17 with the free bottom surface substantially in alignment with a surface of member 17 which defines the upper portion of slot 18. A pusher plate 20, actuated by a double-acting fluid cylinder 20', is adapted to project through slot 18 and to the clamps C, FIG. 4.

Figure 5:
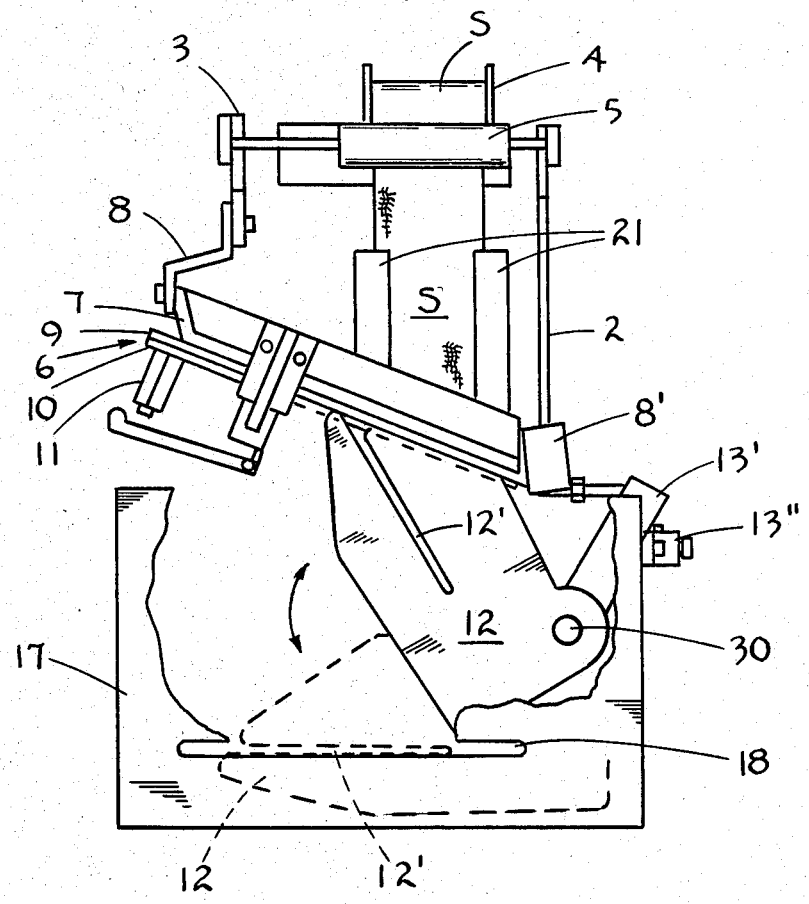
Fig. 5 is a front elevational view of the apparatus of FIG. 4 with parts broken away to show clearly the cutting, orienting, and inserting features of the invention.
Figure 6:
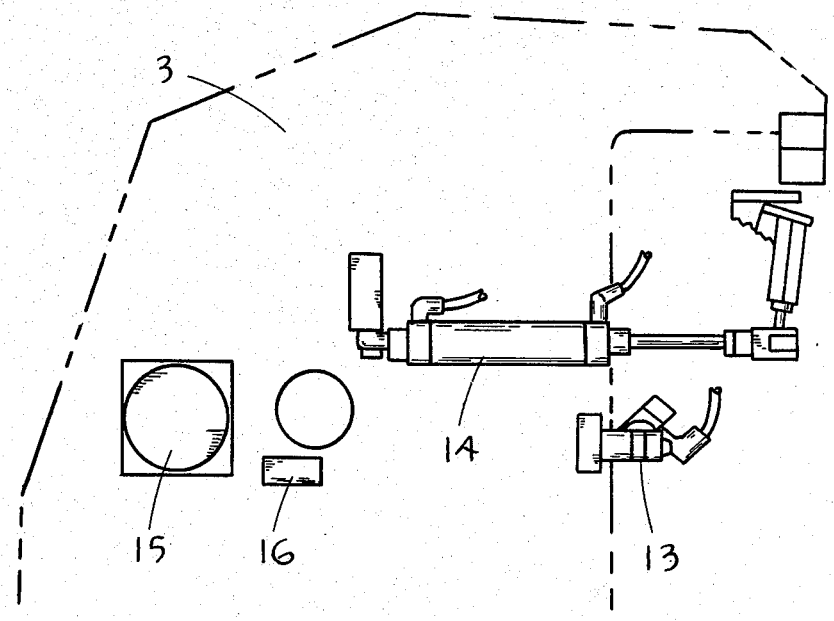
FIG. 6 is a fragmentary, schematic view from the left side of the apparatus showing the fluid motors for activating the shear assembly and the orienting assembly.

As shown in FIGS. 4 and 5, the shear assembly 6 is specifically illustrated and includes anvil means 7, 9 fixed between frame members 2, 3 at 8, 8', and a shear blade 10 pivoted at 11 to anvil 9. Remote from pivot 11, shear fluid motor 14 is connected to shear blade 10 to move the blade to sever the gusset material extending downwardly from a supply roll S and between the anvil 9 and the open shear blade 10. Note that the shear blade 10 is moved in a direction into and out of the plane of paper as viewed in FIG. 2. Note also that the cutting edges of the blade and anvil are inclined downwardly at an angle, preferably about 30°, from the horizontal, and severs the gusset fabric at such an angle B along gusset edges El, E2, FIG. 3B.

Figure 3A:
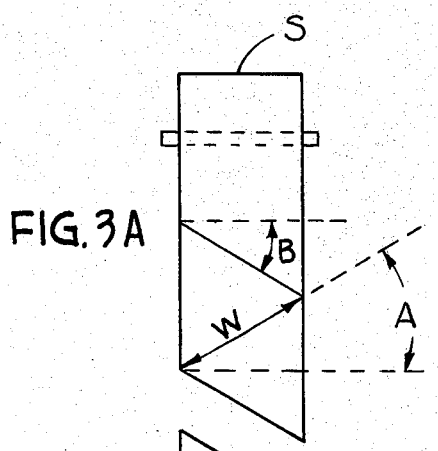
FIG.3 is a schematic view illustrating the displacement and positioning of a gusset insert severed from a gusset fabric supply roll.
Figure 3B:
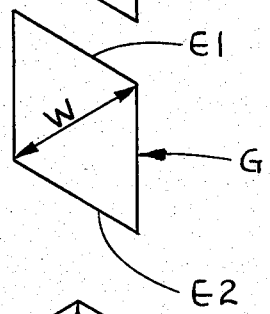
Figure 3C:
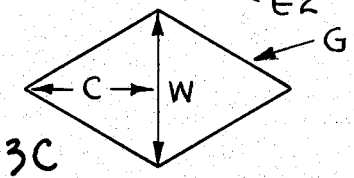
Figure 3D:
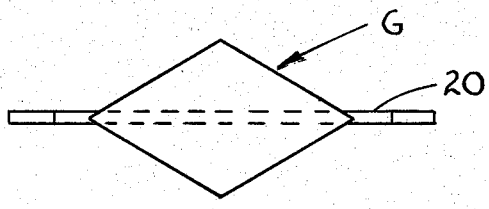
Figure 7:
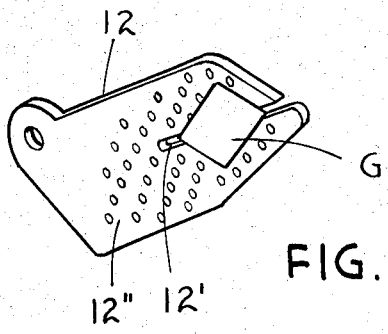
FIG. 7 is a perspective view of the orienting manifold having a gusset positioned thereon.

Pivotably mounted at 30 closely below the shearing assembly 6 is the transferring and orienting manifold assembly 12, as shown in FIGS. 5 and 7. The assembly includes a box-like structure having a slot 12' extending diagonally through a major portion thereof. This slot is directed in the direction of the remote points of the diamond-shaped gusset; see FIG. 7. The manifold pivots between the full and broken line positions of FIG. 5 to transfer the gusset from the FIG. 3B to the FIG. 3C position. The rear portion 12" of the manifold has perforations therein, as shown by FIG. 7, for applying suction or vacuum thereto to support a gusset insert G thereon. A conventional means may be employed for applying suction to the manifold. The fluid cylinder 13, through lever arrangement 13', pivots manifold between the full and broken line positions of FIG. 5. A stop 13" limits upward movement of the manifold by engaging lever 13'. Slot 12' of the manifold, when in the lower position, is in alignment with slot 18 of the front member 17. The pusher plate 20 normally is withdrawn from slots 18, 12' and retracted to a position behind the manifold 12 but still aligned with slot 18.

Located between the shear and manifold assemblies and the feed rolls 5 are spaced U-shaped fabric guide members 21 which may be laterally adjustable for receiving various widths of gusset fabric.

Located on the frame 1 is a conventional sensing and control system to sense various conditions and control the various movements or motions of the above-described structure. For example, upon starting of the machine, the sensing and control means senses the presence or absence of gusset material in position to be severed. If no fabric is in place, feed rolls 5 are actuated to feed a predetermined length of material to and past the open shearing assembly at which time vacuum is applied to the back plate 12" of the manifold to attract the gusset material. The shear assembly is then actuated to sever the gusset material to define a gusset held upon the manifold plate 12". After severing, the manifold is rotated from the full to the broken line position, FIG. 5, with the slots 12' and 18 in alignment with each other and with the pusher plate 20. The vacuum is broken and the pusher plate 20 simultaneously actuated to push the gusset G, which is now folded around the forward edge of the plate 20, through slots 12, 18 and into clamps C where it is placed to be subsequently sewn to two hosiery blanks to define a panty hose garment. At this point the plate 20 is retracted and the manifold is pivoted back to the full line position, FIG. 5, at which time the entire sequence is automatically repeated.

The specific control means for the various functions are known in the art and form no part of the present invention apart from defining an operative device and presenting a complete disclosure.

What is claimed is:

1. An apparatus for forming inserts such as gussets or the like of predetermined configuration to be sewn to hosiery blanks to define panty hose or other type lower body garments comprising:

a frame structure positioned adjacent to and oriented with a machine having a pair of clamps adapted to hold the hosiery blanks as well as the gussets;

a support for holding a supply of material from which the gussets are formed;

a feeding assembly positioned downstream of said support for intermittently feeding said material;

a cutting device having fixed and moveable blades between which blades said material is intermittently fed, the cutting edges of said blades being positioned at a predetermined angle for cutting said material into such predetermined angle for cutting said material into such predetermined configuration; and a transfer and orienting mechanism downstream of said cutting device for orienting and placing the cut gussets in a location adjacent the path of said clamps, reciprocable pusher means positioned adjacent to and on the side of the formed and oriented gusset remote from said clamps, and means to move said pusher means into engagement with said gusset and push same into said clamps for subsequent uniting with said hosiery blanks or the like.

2. The apparatus as defined in claim 1 wherein said feeding assembly includes feed rollers between which said material is directed and means to intermittently drive said rollers to feed a predetermined amount of material to said cutting device.

3. The apparatus as defined in claim 2 including guide means located between said feeding assembly and said cutting device to guide the gusset material to and between said blades.

4. The apparatus as defined in claim 1 including guide means located between said feeding assembly and said cutting device to guide the gusset material to and between said blades.

5. The apparatus as defined in claim 1 wherein said moveable blade is pivotally attached at one end thereof to the corresponding end of said fixed blade, the cutting edges of said blades lying in contiguous planes at an acute angle with respect to the vertical, and including means to reciprocate said moveable blade.

6. The apparatus as defined in claim 1 wherein the gusset material is in the form of an elongated rectangular sheet having parallel laterally spaced sides and wherein the material is fed to the cutting device in a substantially vertically oriented plane with the edges thereof extending in a vertical direction and wherein the cutting device is positioned with said blades being located at an acute angle relative to said edges thereby to cut said material on said angle.

7. The apparatus as defined in claim 6 wherein said feed assembly includes rollers driven for intermittent rotation.

8. The apparatus as defined in claim 1 wherein said transfer and orienting mechanism includes a box-like vacuum manifold having spaced front and rear substantially planar surfaces with the rear surface thereof being perforated, the manifold having an elongated slot therein, and means to apply a vacuum or suction thereto.

9. The apparatus as defined in claim 8 wherein the rear planar surface is in substantial alignment with the cutting device, and thus the gusset material, to attract said material as same is being cut.

10. The apparatus as defined in claim 9 wherein the manifold is mounted for movement from an upward position where the cut gusset material is attracted thereto to a lower position where the material is released for placing same into the path of said gusset pusher means and including means to move said manifold between said positions.

11. The apparatus as defined in claim 10 wherein the elongated slot is located at an acute angle when the manifold is in the upward position and is located in horizontal position and in alignment with said gusset moving means in said lower position.

* * * * *